United States Patent [19]

Parrish

[11] Patent Number: 4,861,653

[45] Date of Patent: Aug. 29, 1989

[54] PITCH CARBON FIBERS AND BATTS

[75] Inventor: Robert G. Parrish, Wilmington, Del.

[73] Assignee: E. I. Du Pont De Nemours and Company, Wilmington, Del.

[21] Appl. No.: 92,217

[22] Filed: Sep. 2, 1987

[51] Int. Cl.[4] ..... D04H 1/58

[52] U.S. Cl. ..... 428/288; 264/29.2; 423/447.4; 423/447.6; 428/221; 428/224; 428/284; 428/297; 428/300; 428/408

[58] Field of Search ..... 423/447.4, 447.6; 264/29.2; 428/221, 284, 288, 297, 298, 300, 408, 224

[56] References Cited

U.S. PATENT DOCUMENTS

| | | | |
|---|---|---|---|
| 3,776,669 | 12/1973 | Ito et al. | 425/8 |
| 4,032,607 | 6/1977 | Schulz | 264/29.3 |
| 4,323,524 | 4/1982 | Snowden | 264/8 |
| 4,356,228 | 10/1982 | Kobayashi et al. | 428/283 |
| 4,497,789 | 2/1985 | Sawran et al. | 423/447.4 |

FOREIGN PATENT DOCUMENTS

| | | |
|---|---|---|
| 58-203105 | 11/1983 | Japan . |
| 60-173121 | 9/1985 | Japan . |
| 61-22044 | 5/1986 | Japan . |
| 2095222 | 9/1982 | United Kingdom . |
| 2177733 | 1/1987 | United Kingdom . |

OTHER PUBLICATIONS

Extended Abstracts of the 16th Biennial Conference on Carbon, 1983, pp. 515, 516.

Composites Science and Technology 25, 1986, pp. 231–241.

*Primary Examiner*—James J. Bell

[57] ABSTRACT

Mesophase pitch centrifugally spun as described over a lip yields upon stabilization and carbonization with or without graphitization carbon fibers with a lamellar microstructure.

8 Claims, 5 Drawing Sheets

PITCH CARBON FIBERS AND BATTS

BACKGROUND OF THE INVENTION

The centrifugal spinning of fibers from pitch is known in the art. Reference may be had to several methods, types of apparatus and kinds of pitches which may be employed. In some instances, the prior art practices will result in large diameter fibers or fibers with relatively poor mechanical properties. Others result in low throughput or in fibers with no discernable microstructure.

It is an object of the present invention to produce at high throughputs sub-denier pitch carbon fibers of defined microstructure which are particularly useful as reinforcement in polymer matrix composites and for the enhancement of the thermal and electrical conductivity thereof.

THE DRAWINGS

FIG. 1 is a schematic of a spinning and laydown apparatus for preparing products of the invention.

FIG. 2 is a cross-sectional view of the spinning rotor shown in FIG. 1, taken in a plane which includes the axis of the drive shaft.

FIG. 3 shows an enlarged view of another embodiment of the rotor lip from which the pitch fibers are spun.

FIG. 4 is a scanning electron photomicrograph (SEM) of a definitive fiber fracture surface observed in fiber cross sections of products of the invention. This figure was obtained from the product of Example 1.

FIG. 5 is a SEM of a self-bonded batt produced in accordance with this invention and similar to that produced in Example 1.

FIGS. 6*a* to 6*c* are SEM's of representative fiber fracture surfaces of products of the invention and were obtained from Example 3.

SUMMARY OF THE INVENTION

This invention provides a batt of randomly disposed carbon fibers from centrifugally spun mesophase pitch, said fibers predominantly having in cross-section a width of less than about 12 micrometers and a fracture surface exhibiting a lamellar microstructure composed of lamellae arranged in an isoclinic relationship and disposed in a direction generally parallel to an axis of the cross-section, the lamellae extending to the periphery of the fiber cross-section. The fibers comprising the batt may be bonded to each other. The invention further contemplates a process for preparing such fibers and batts as well as composites reinforced with such fibers and batts or fragments thereof.

DETAILED DESCRIPTION OF THE INVENTION

In accordance with the present invention one obtains, in an economic manner, fine denier carbon fibers with a unique lamellar microstructure from centrifugally spun mesophase pitch. In general, the fibers have a cross-sectional width of less than about 12 micrometers (microns), usually from about 2 to 12 micrometers. The actual denier of such fibers will depend on the density as well as the size of the particular fiber which may, in highly graphitic structures (density $>2.0$ g/cc), numerically exceed 1.0 denier per filament (dpf). The fiber widths are variable and may be measured on an SEM of known magnification. The fiber lengths also are variable and preferably exceed about 10 mm. in length. The fibers may have "heads", that is, an end segment with a diameter or width that is greater than the remainder or the "average" of the fiber. It is preferred that these "heads" be minimized because they do not add value in most end-use applications. The "heads" should be ignored in taking measurements of the fiber dimensions, especially widths. The size and shape of the "heads" is influenced by the level of force in spinning, the spinning temperature, the nature of the pitch, the spin apparatus and also can be influenced by quenching conditions.

By "mesophase pitch" is meant a carbonaceous pitch, whether petroleum or coal-tar derived, having a mesophase content of at least about 40 percent, as determined optically utilizing polarized-light microscopy. Mesophase pitches are well-known in the art and are described, inter alia, in U.S. Pat. No. 4,005,183 (Sinqer) and U.S. Pat. No. 4,208,267 (Diefendorf and Riggs). Fibers prepared from centrifugally spun isotropic pitches generally do not exhibit a discernable microstructure, are tedious to stabilize and often exhibit relatively poor mechanical properties. In contrast, fibers of this invention show fracture surfaces with a distinct lamellar or layered microstructure readily observed when such fracture surfaces are viewed at magnifications of 5,000× or higher, especially after the fibers have been exposed to temperatures in excess of about 2000° C. The lamellae are disposed in a direction generally parallel to an axis (usually the major axis) of the cross-section and extend to its periphery. It is believed that this microstructure is evidence of a very high degree of structural order and perfection, and further that such a highly ordered structure explains the enhanced thermal and electrical conductivity of such fibers.

The process employed in preparing the products of this invention consists essentially of centrifugally spinning a mesophase pitch, at elevated temperatures, over a lip, at centrifugal forces in excess of 200 times the force of gravity (i.e., in excess of "200 g's"). The as-spun fibers usually are collected in the form of a batt having an areal density of from 15 to 600 grams per square meter ("g/m$^2$") with the fibers being randomly disposed in the plane of the batt. It is desirable not to exceed an areal density of 600 g/m$^2$ in order to avoid "hot spots" during the subsequent oxidative stabilization step. The use of mesophase pitch is believed to be critical. It is also believed important that the pitch be spun without circumferential restraint, such as over a lip, in order to permit the extensional flow of a planar, shear-oriented film of molten pitch. Conventional centrifugal spinning of pitch through confining or shaping orifices, e.g., holes, generally limits throughput, provides larger fibers and, with highly mesophasic pitch, spinning continuity often may be limited by plugging. Such spinning also will not result in the lamellar fiber microstructure. For example, use of mesophase pitch in conventional centrifugal spinning (GB No. 2,095,222A) results in a "random mosaic" microstructure.

The term "lip", as used above, describes an edge or opening that does not restrain, confine or otherwise shape the molten pitch as it leaves the spinning apparatus. Centrifugal spinning of mesophase pitch over a lip requires relatively high spinning temperatures and centrifugal forces in order to produce fine-denier fibers.

Centrifugal forces of at least 200 g's, preferably more than 1000 g's and as high as 15,000 g's have been found useful. If the centrifugal force or temperature during spinning is too low, only particles rather than fibers may be produced. The nature of the pitch and the particular configuration of the spinning apparatus will determine the optimum spinning conditions. Rotor temperatures at least 100° C. above the pitch melting point should be employed for spinning. Temperatures of at least 375° C. and preferably within the range of 450° to 525° C. have been found useful for spinning. Excessively high temperatures are to be avoided since they lead to coke formation. A pitch having a mesophase content of about 100% will normally require a higher spinning temperature than a pitch of lower mesophase content. The melt viscosity of the pitch is normally determined by the extent to which the spinning temperature exceeds the melting point of the pitch.

The fibers of this invention are advantageously prepared in the form of batts. Batts can be produced in a range of areal densities for the reinforcement end-uses contemplated herein, should lie between 15 and 600 $g/m^2$. To prepare the batts, the pitch fibers are centrifugally spun into a collection zone and are then advantageously directed onto a moving porous belt. The fibers are ordinarily randomly arrayed within the plane of the batt, that is, no particular pattern is displayed. The areal density or basis weight of the batt can be varied by the rate of pitch deposition on the belt (pitch throughput rate) or preferably by adjusting the velocity of the moving belt or other collection means.

After spinning and collecting the fibers in batt form, the batt of as-spun fibers is subjected to stabilization. Surprisingly, this step proceeds at a much faster rate than normally expected with conventionally spun pitch carbon fibers. The invention permits use of lower stabilization temperatures and shorter periods of stabilization. If desired, the conditions of stabilization, e.g., higher temperatures, may be employed to achieve self-bonding of the as-spun fibers of the batt at their contact or crossover points. Stabilization is usually effected by heating in air at temperatures between 250° C. to 380° C. for a time sufficient to enable later precarbonization without melting. Depending on stabilization temperature, the fibers in the batt will remain free of one another and may be later separated. At higher stabilization temperatures self-bonding will take place. Self-bonding may be assisted by employing lateral restraint, such as placement of the batt between screens with minimal compression to offset shrinkage forces. There results from self-bonding a three-dimensional, unitary network of fibers which, after carbonization, yields a structure suitable for impregnation. The self-bonded batt may be broken into fibrous fragments (mixture of straight fibers and "X","Y", etc. shaped bonded fragments) and can be employed as a reinforcement material. Properly stabilized batts may be combined for later ease of processing. For example; batts may be laid up and needled to prevent delamination and thereafter processed conventionally.

After stabilization, the fibers or batts are devolatilized or "precarbonized" in an inert gas atmosphere (nitrogen, argon, etc.) at temperatures between 800° C. and 1500° C., preferably between 800° C. and 1000° C. This step rids the fibers of the oxygen picked up in stabilization in a controlled manner. The devolatilized batts may be carbonized by microwave radiation. Ordinarily, the fibers and batts are carbonized or carbonized and graphitized in accordance with art-recognized procedures, i.e., at temperatures from about 1600° C. to 3000° C. in an inert atmosphere for a time of at least one minute. It is the carbonized or carbonized and graphitized fiber that exhibits the lamellar structure referred to previously. The batts may be surface treated, by known methods, to enhance fiber-to-matrix adhesion in composites end-use applications. The fibers in the batt may be bonded to each other through use of an adhesive and such bonded batts may be laid up and additionally bonded to each other. If desired, the fibers or batts can be combined with other fibers (e.g., glass, aramid, etc.) or batts thereof to provide "hybrid" batts, mixed laminates, etc.

The fibers as laid in the batt are of relatively short length. A decreasing feed rate or throughput has been found to yield fibers of increased length. The temperature of the pitch can be adjusted by the external heating means (e.g., the induction coil), thereby altering its viscosity.

Rotors having a diameter of about three inches have been used successfully. If desired, quenching gases to accelerate or delay the solidification of the molten pitch upon leaving the rotor may be accommodated in the spinning apparatus.

Figure 1:
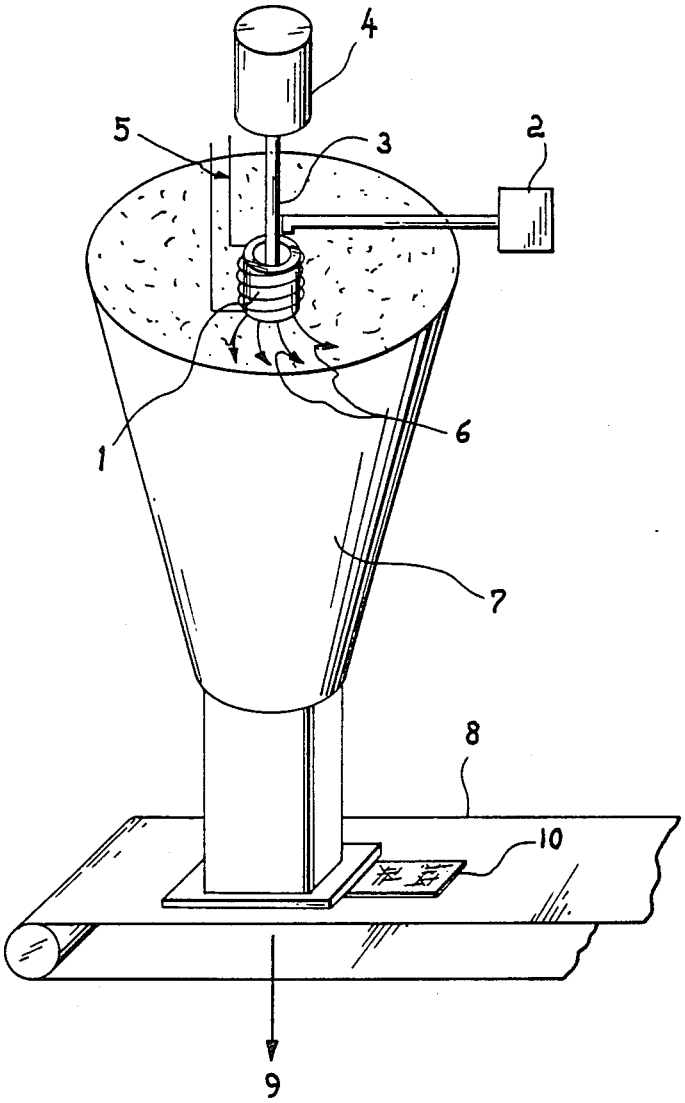
Referring to FIG. 1, solid pitch is introduced (metered) into the spinning rotor 1 by feed means 2 which, in the embodiment shown, is a screw feeder. Spinning rotor 1 is mounted on drive shaft 3 which, in turn, is driven at high rates of revolution by drive means 4. Spinning rotor 1 is surrounded by heating means 5 which, in this embodiment, is depicted as an electric induction coil. The pitch is melted in rotor 1 via heating means 5 and centrifugally spun into fibers, the trajectory of which is shown by arrows 6, into the collection means 7, a conical container installed around the rotor 1 with apex lying vertically below the rotor. The apex is connected to an exit channel. The maximum diameter of the conical container should be at least 5 to 12X larger than that of the rotor. The container is covered (cover not shown) except for openings to permit introduction of a gas, e.g., air or nitrogen, which may or may not be heated, circumferentially at the top and also through an opening above and surrounding the rotor. An endless screen conveyor belt 8, is placed in the path of the exit channel which is connected to vacuum source 9. While the fibers are collected in the form of a random batt 10 on belt 8, the gas passing through the batt 10 controls fiber deposition.
Figure 2:
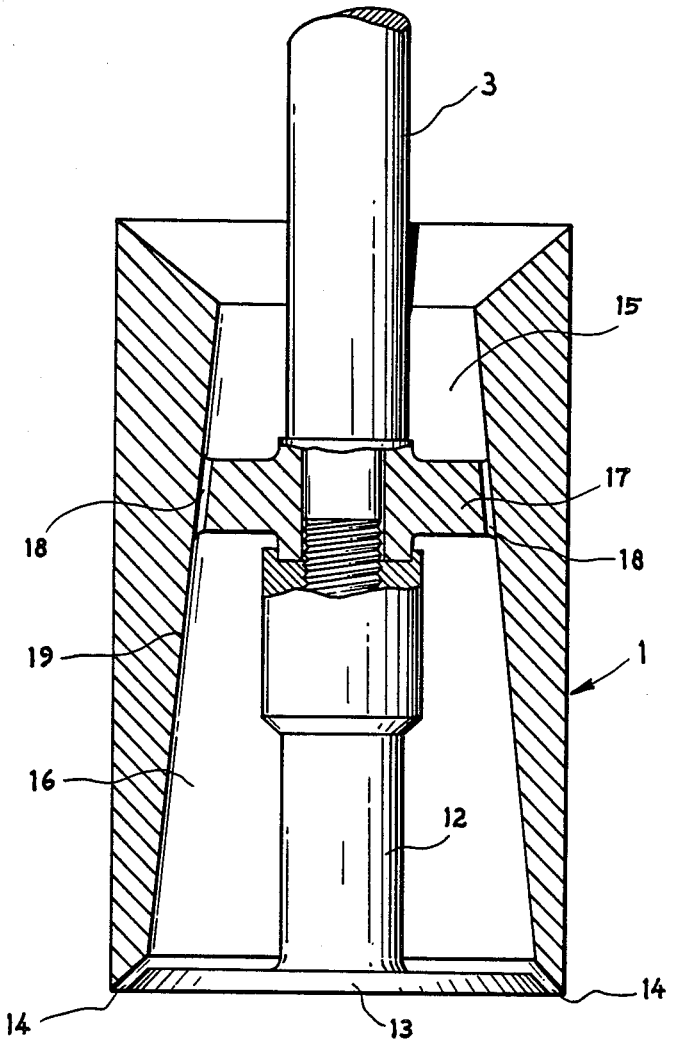

Referring to FIG. 2, rotor 1 is attached to drive shaft 3. The attachment shaft 12 supports baffle plate 13. which prevents cooling of the pitch via back-flow of the quenching medium. Rotor 1 has an upper chamber 15 separated from lower chamber 16 by web 17 which contains circumferentially and regularly spaced pitch supply holes 18. The inner wall 19 of lower chamber is disposed at a slight angle, typically 10°, from the vertical (i.e., from the axis of the draft shaft 3) to ensure uniform flow of molten pitch from holes 18 along the wall 19 to the spinning lip 14. In operation, solid pitch is supplied to the upper chamber 15 where it melts and flows through holes 18 to lower chamber 16 and flows along wall 19 to spinning lip 14 where centrifugal forces spin the molten pitch off lip 14 in the form of fibers into collection means 7 shown in FIG. 1. The fibers are quenched by the gas entering the collection chamber 7 and are directed to screen belt 8 of FIG. 1. The centrifugal force on the molten pitch at lip 14 is a function of the diameter of rotor 1 and the rate of revolution of the rotor.

Figure 3:
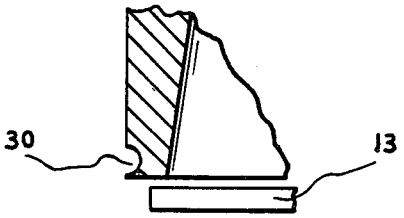

Referring to FIG. 3, there is shown an enlarged view of baffle plate 13 and arcuate spinning lip 30 of rotor 1. This arcuate feature is believed to inhibit accumulation of pitch in the vicinity of the lip and subsequent degradation of the pitch, which would otherwise have an adverse effect on spinning continuity.

Figure 4:
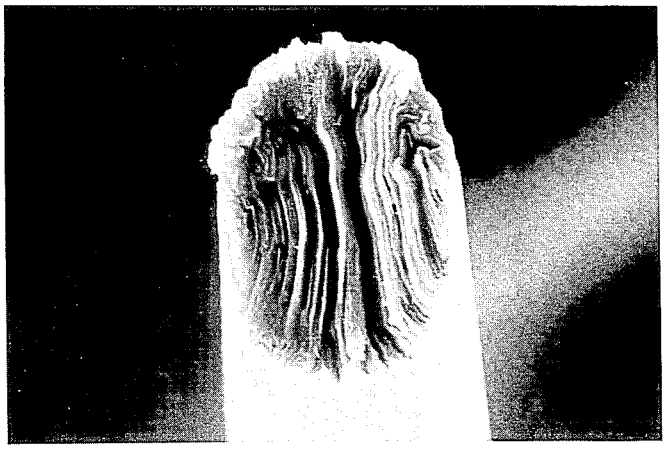

FIG. 4 shows in cross-section the fracture surface of a pitch fiber centrifugally spun from a lip in accordance with the foregoing discussion. The fiber was sectioned (broken) with a razor blade, inclined to better display the microstructural features, then SEM photograph was taken at 5000× magnification.

The lamellar structure is readily apparent. Overall the fiber cross-section is elliptical, the lamellae are generally parallel to the major axis of the ellipse and they extend to the periphery of the fiber. The lateral spacing between lamellae does not appear to be regular but groups of lamellae tend to "parallel" one another, usually in an isoclinic (i.e., contour-following) relationship. The fiber shown in FIG. 4 was prepared in Example 1 at a temperature of 2215° C.

Figure 5:
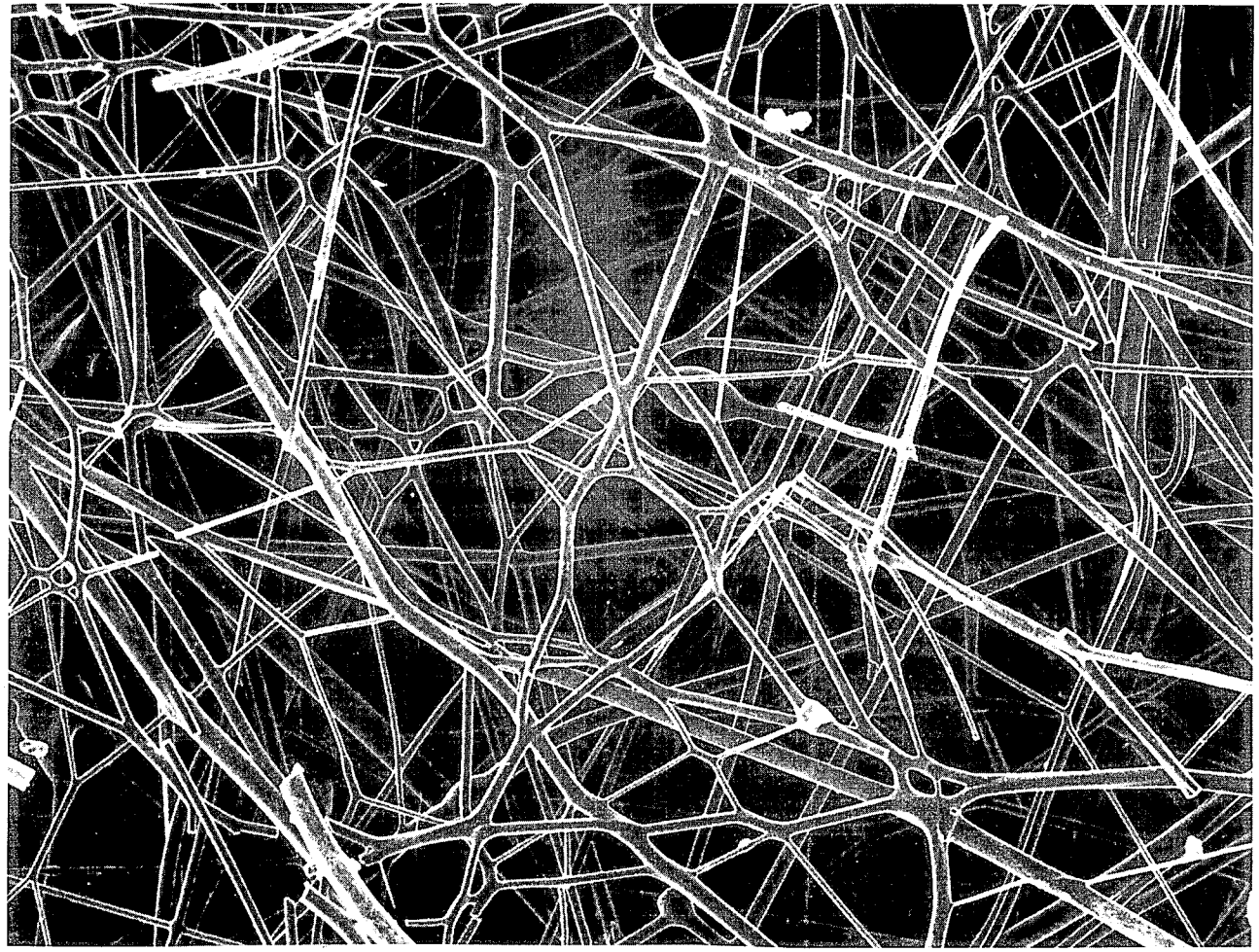

Referring to FIG. 5, the self-bonded batt of Example 1 is displayed photomicrographically (SEM; 5000×). A structure showing smooth bonding at fiber cross-overs and lateral contacts is observed.

Referring to FIGS. *6a* to *6c*, there are shown additional photomicrographs of cross-sectional fracture surfaces of the fibers of the invention, taken at the following magnifications: FIG. *6a* is 7000×; *6b* is 9000×; *6c* is 10,000×. The fibers samples were obtained from Example 3, hereinafter. Each of FIGS. *6a–6c* shows the lamellar microstructure described in detail in connection with FIG. 4. It is also apparent that microstructural features are not as regular as in FIG. 4. It is believed that such departures often may be due to transitory disturbances of the planar shear flow of the molten pitch during spinning. It is further believed that the "fanlike" structure shown in FIG. *6a* is the most representive of the products of this invention. Note that photomicrographs taken at break points (e.g. after tensile testing) likely are not representative, the breaks often having been caused by voids, particulates, or other such atypical disparities. Blade marks can occasionally disrupt the fracture surface.

The following examples are illustrative:

EXAMPLE 1

The pitch was prepared from a "Lake Charles thermal tar" (Conoco, Inc.), a heavy oil residue from the thermal cracking of gas oil, by heat soaking and nitrogen sparging to yield an 85% mesophase pitch having a softening point point of 279° C. and a melting point of 300° C. This pitch was centrifugally spun from the rotor shown in FIG. 2 at an induction-heated rotor wall temperature of 475° C. The rotor employed has a diameter of 3.25 inches, a taper of 10 degrees and was rotated at 10,000 rpm to produce a centrifugal force of 4600 g's. The flow rate of the powdered pitch to the rotor was 0.3 pounds per hour. Web 17 has 12 supply holes 18, each ¼" in diameter. Fibers were quenched by air at ambient temperature, the flow of which conveyed the fibers onto a wire screen to form a two-dimensionally random batt, the areal density of which was 80 grams per square meter.

In a separate process step, a 2"×4" sample of the above batt was cut and placed between fine wire screens. This assembly was then placed between the platens of a vertical press which was previously heated to and then maintained at 380° C. in air. The platen gap was set at 1" for the first 0.5 and at ⅜" for the remaining 1.5 minutes of the 2 minute cycle, during which step both stabilization and self-bonding took place. The platens were not employed to exert pressure on the batt but rather to provide heat during stabilization. The batt was then heated to 850° C. in nitrogen for devolatization followed by graphitization at 2215° C. in argon. On the average, the fibers in the batt have a width of 6.1 microns. Fibers were broken with a razor blade to expose the cross-sectional fracture surface shown, as described, in FIG. 4.

EXAMPLE 2

In another embodiment, the pitch was prepared from a Ponca City decant oil (Conoco, Inc.), also known as slurry oil or clarified oil, a residue from the catalytic cracking of gas oil, which was heat soaked and nitrogen sparged to provide a 99% mesophase pitch having a softening point of 265° C. and a melting point of 297° C. The pitch was centrifugally spun using the apparatus of Example 1, a rotor temperature of 486° C., and a rotational speed of 18,000 rpm to produce a centrifugal force of 15,000 g's. The pitch flow rate was 5 pounds per hour. The rotor lip was as shown in FIG. 3. The fibers were collected on a moving belt to form a batt having an areal density of 80 grams per square meter. Individual fibers had a slightly tapered shape, an average width of 11.2 microns and an average length of 4 centimeters.

In a separate process step, fibers in batt form were reacted in air at a temperature of 240° C. for 10 minutes then at 300° C. for 10 minutes in order to stabilize them. Precarbonization and graphitization were accomplished by heating from room that temperature to 2600° C., in argon, then holding at used to make a laminate (composite) with epoxy resin (Hercules 3501-6 containing 20% Araldyte RD-2 [Ciba Geigy] viscosity reducing agent), said laminate containing 33 volume percent of fibers. Samples 6 inches long, 0.5 inches wide were cut from the laminate, which was 0.054 inches thick. These samples were subjected to the three point bending test at a span-to-depth ratio of 60 and found to have a bending modulus of 3.18 million psi.

EXAMPLE 3

In another embodiment, the supply decant oil of Example 2 was heat soaked with nitrogen sparging to provide a 100% mesophase pitch having a softening point of 293° C. and a melting point of 328° C. The apparatus of Example 1 was employed, the rotor temperature was 525° C., the rotational speed was 10,000 rpm (4600 g's) and the pitch flow rate was 0.3 pounds per hour. The fibers were collected on a cheese cloth supported by a fine wire screen to provide a batt with an areal density of 150 grams per square meter. The fibers had an average width of 7.4 microns. Many fibers had lengths in excess of 5 centimeters.

Figure 6A:
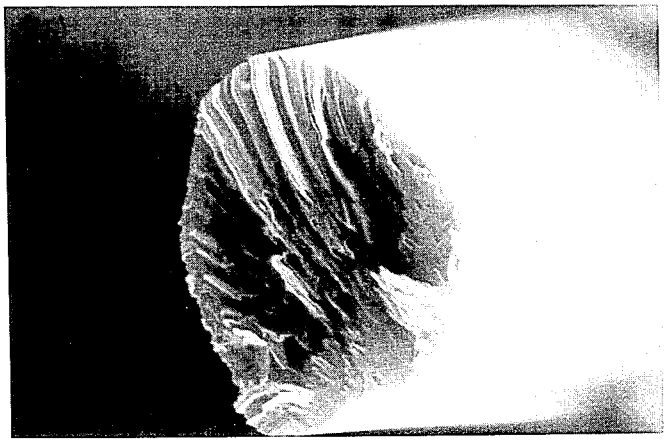
Figure 6B:
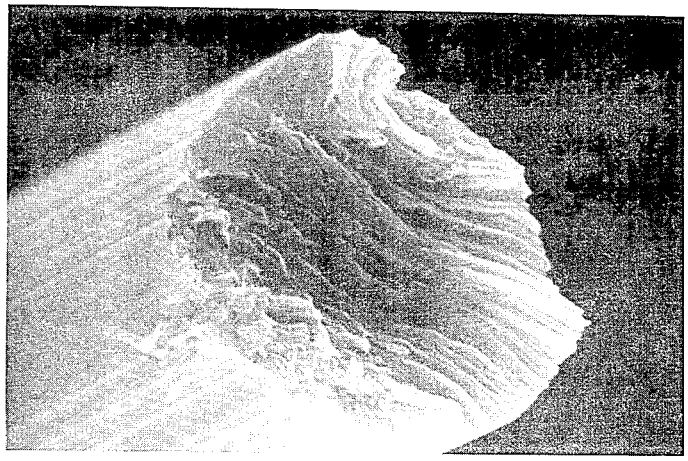
Figure 6C:
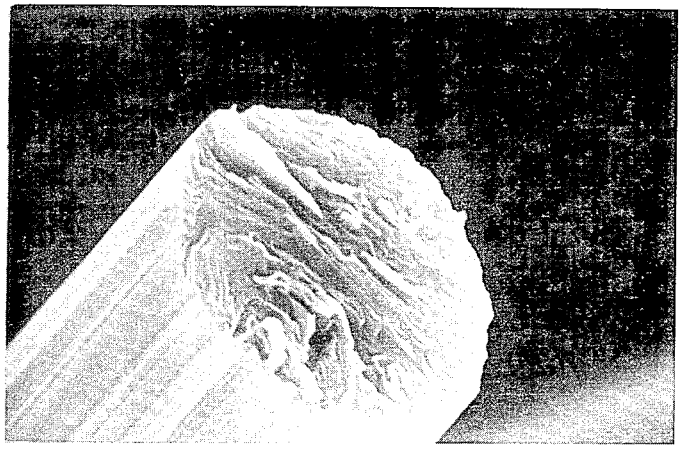

In a separate process step, the fiber batt was reacted in air in an oven which was programmed to increase in temperature from ambient to 340° C. at the rate of 4° C. per minute. On reaching this temperature the heater was turned off, and the oven allowed to cool down. The cooling rate was approximately the same as the heating rate. This treatment made the filaments infusible, and prepared them for subsequent carbonization. The fiber batt was next placed in a muffle furnace and heated to 850° C. in a nitrogen atmosphere, to remove volatile pitch components and start the carbonization process. The fiber batt was subsequently carbonized by heating to 2166° C. in an argon atmosphere. Filaments were teased out of the batt and tensile tested at 1" gauge length. The average tensile strength was 228 kpsi, and the average modulus 33.7 mpsi. These properties make the fiber useful for reinforcement of resin, polymer, metal or ceramic matrices, to provide useful prepregs, laminates and other forms of composites thereof. The batt was cut with a razor blade to to produce a sample for viewing in the SEM. Most fibers showed the characteristic lamellar microstructure; representative ones are shown, as described, in FIGS. 6*a* to 6*c*.

I claim:

1. A batt of randomly disposed carbon fibers, said fibers predominantly having in cross-section a width of less than about 12 micrometers and a fracture surface exhibiting a lamellar microstructure composed of lamellae arranged in an isoclinic relationship and disposed in a direction generally parallel to an axis of the fiber cross-section, the lamellae extending to the periphery of the fiber cross-sections.

2. A batt according to claim 1 wherein the fibers are bonded to each other.

3. A composite reinforced with the batt of claim 1 or 2 or fragments thereof.

4. A batt according to claim 1 formed from centrifugally spun mesophase pitch which was oxidatively stabilized and carbonized.

5. A process for preparing the batt of randomly disposed carbon fibers comprising centrifugally spinning a molten mesophase pitch, said pitch being spun at a temperature of from 375° C. to 525° C. over the lip of a rotor and into a chamber, at a centrifugal force of from 200 to 15,000 g., quenching the spun fiber in the chamber and directing the fiber on to a collection means to form a batt of randomly disposed pitch carbon fiber, oxidatively stabilizing the fiber of the batt and carbonizing the fiber of the batt.

6. A process according to claim 5 wherein the pitch is spun at a centrifugal force of at least 1000 g.

7. A process according to claim 5 wherein the fiber of the batt is self-bonded during the oxidative stabilization.

8. A batt prepared by the process of claim 5.

* * * * *